United States Patent [19]

Deutsch et al.

[11] 3,982,361

[45] Sept. 28, 1976

[54] MODIFIED STRUCTURE FOR LINING GENERALLY CURVED SURFACES

[75] Inventors: Ernst Deutsch; Bernhard Reifenscheid, both of Marl, Germany

[73] Assignee: Chemische Werke Huls Aktiengesellschaft, Germany

[22] Filed: Dec. 23, 1974

[21] Appl. No.: 535,983

Related U.S. Application Data

[63] Continuation-in-part of Ser. No. 457,214, April 1, 1974, abandoned.

[30] Foreign Application Priority Data

Dec. 21, 1973 Germany ..... 2363706

[52] U.S. Cl. ..... 52/80; 52/63; 52/83; 52/222; 52/582; 52/753 J

[51] Int. Cl.[2] ..... E04B 7/14; E04B 7/10

[58] Field of Search ..... 52/80, 63, 83, 222, 52/582, 753 C, 753 J, 81, 460, 400, 463, 467

[56] References Cited

UNITED STATES PATENTS

| | | | |
|---|---|---|---|
| 838,693 | 12/1906 | Degenhardt | 52/395 X |
| 892,034 | 6/1908 | Drouve | 52/460 |
| 1,227,861 | 5/1917 | Waugh | 52/395 |
| 1,825,800 | 10/1931 | Houseman | 52/80 |
| 2,102,902 | 12/1937 | Lenke | 52/395 |
| 2,203,174 | 6/1940 | Muttray et al. | 52/81 |
| 2,293,569 | 8/1942 | Sonino | 52/71 |
| 2,986,150 | 5/1961 | Torian | 52/582 X |
| 3,129,531 | 4/1964 | Connor | 52/403 X |
| 3,137,097 | 6/1964 | Zeinetz | 52/80 |
| 3,158,961 | 12/1964 | Hawkins | 52/71 X |
| 3,186,128 | 6/1965 | Charles | 52/80 |
| 3,192,669 | 7/1965 | Hawkins | 52/81 |
| 3,394,506 | 7/1968 | Thompson | 52/80 X |

FOREIGN PATENTS OR APPLICATIONS

| | | | |
|---|---|---|---|
| 343,623 | 2/1960 | Switzerland | 52/80 |
| 62,277 | 9/1912 | Switzerland | 52/463 |
| 46,805 | 1/1909 | Switzerland | 52/463 |

*Primary Examiner*—Ernest R. Purser
*Assistant Examiner*—Leslie Braun
*Attorney, Agent, or Firm*—Craig & Antonelli

[57] ABSTRACT

An assembly for lining a support means thereby forming a structure having generally curved surfaces comprises connector means adapted to be joined to the support means via an intermediate mounting means, the connector means having two clamping means and filling means therebetween to regulate the distance between the individual clamping means, and covering means elastically retained by the connector means and being shaped to cover the support means, the covering means comprising a fabric cover having a spatial double curvature and being under tensile stress.

22 Claims, 8 Drawing Figures

FIG. 2
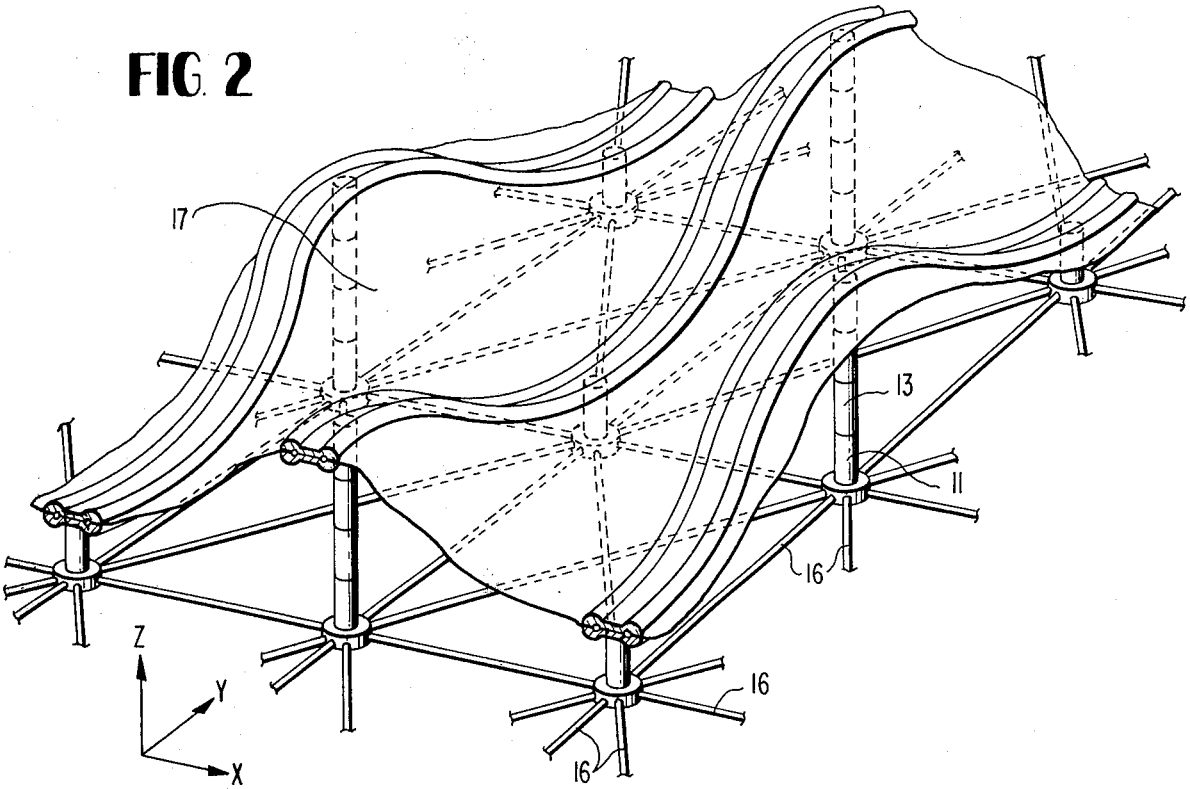
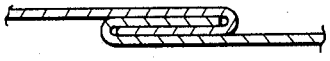
FIG. 5a
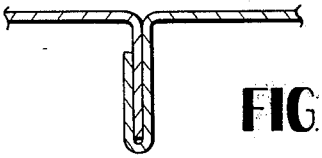
FIG. 5b
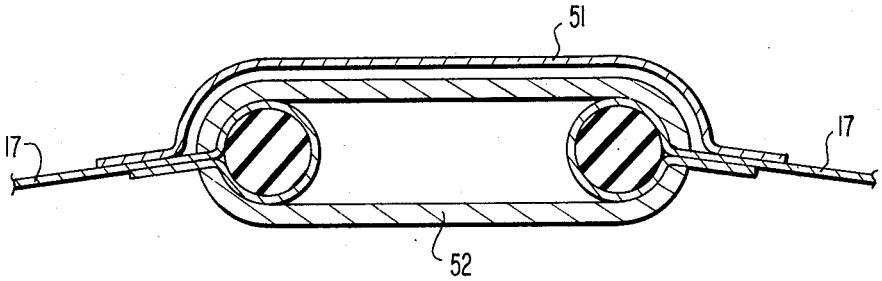
FIG. 6

MODIFIED STRUCTURE FOR LINING GENERALLY CURVED SURFACES

CROSS-REFERENCE TO RELATED APPLICATION

The present application is a continuation-in-part of application Ser. No. 457,214, filed Apr. 1, 1974.

BACKGROUND OF THE INVENTION

Patent application Ser. No. 457,214, filed Apr. 1, 1974, the disclosure of which is incorporated herein by reference, relates to a system or assembly for lining a support means thereby forming a structure having generally curved surfaces which comprises a connector means adapted to be joined to the support means via an intermediate mounting means, the connector means having two clamping means and a filling means therebetween to regulate the distance between the individual clamping means, and covering means elastically retained by said connector means and being shaped to cover said support means.

More specifically, parent application 457,214 relates to a system or assembly for the lining of generally curved surfaces which as shown in FIG. 1 herein comprises:

a. a connector panel connected to the basic construction by way of a firm or elastic intermediate element 11 and consisting of at least two associated clamping plates 31 and 32, which connector panel can also be fashioned as a connector strip and which has, in the center, a filling panel 33 for regulating the spacing of the individual clamping plates or strips. The connector panel normally holds two bearing profile members 34 of an aging-resistant and weathering-resistant vulcanized elastomer, the connector panel thereby forming appropriate mounting means for elastically holding lining panels 38;

b. covering or lining panels 38 adapted in their dimensions to the system to be lined and optionally being reinforced along their edges; and optionally c. sealing panels (not shown) serving for the covering of certain panel edges.

SUMMARY OF THE INVENTION

It has now been found that it is also possible to utilize in place of the optionally edge-reinforced covering panels indicated in this system under (b), a fabric cover which is stretched in the manner of a diaphragm so that it exhibits a spatial double curvature and is under tensile stress.

Accordingly, the present invention provides an assembly for lining a support means thereby forming a structure having generally curved surfaces comprising (a) connector means adapted to be joined to the support means via an intermediate mounting means, the connector means having two clamping means and filling means therebetween to regulate the distance between the individual clamping means, and (b) covering means elastically retained by the connector means and being shaped to cover the support means, the covering means comprising a fabric cover stretched in the manner of a diaphragm so that it exhibits a spatial double curvature and is under tensile stress.

More specifically, the present invention provides an assembly for sheathing a network thereby forming a structure having generally curved surfaces comprising a connector panel or strip adapted to be joined to the network via a firm or elastic intermediate element, the connector panel or strip comprising at least two associated clamping plates and a filling panel therebetween to regulate the distance between the individual clamping plates or strips, the connector panel or strip holding two bearing profile members of a weather resistant and aging-resistant vulcanized elastomer, and a covering panel attached to at least one of the bearing profile members held by the connector panel or strip, the covering panel being shaped to fit the network and comprising a fabric cover stretched in the manner of a diaphragm so that it exhibits a spatial double curvature and is under tensile stress.

BRIEF DESCRIPTION OF THE DRAWINGS

The present invention may be more readily understood by reference to the following drawings:

FIG. 2 is a perspective view of a covering or lining assembly made in accordance with the present invention;

FIGS. 5*a* and 5*b* are cross-sectional views illustrating two seam structures for joining adjacent fabric sheaths used to form a fabric cover in accordance with the present invention; and FIG. 6 is a cross-sectional view illustrating a technique for securing together two adjacent cover panels in accordance with the present invention and a sealing panel for covering the space between the adjacent cover panels.

DETAILED DESCRIPTION

Figure 1:
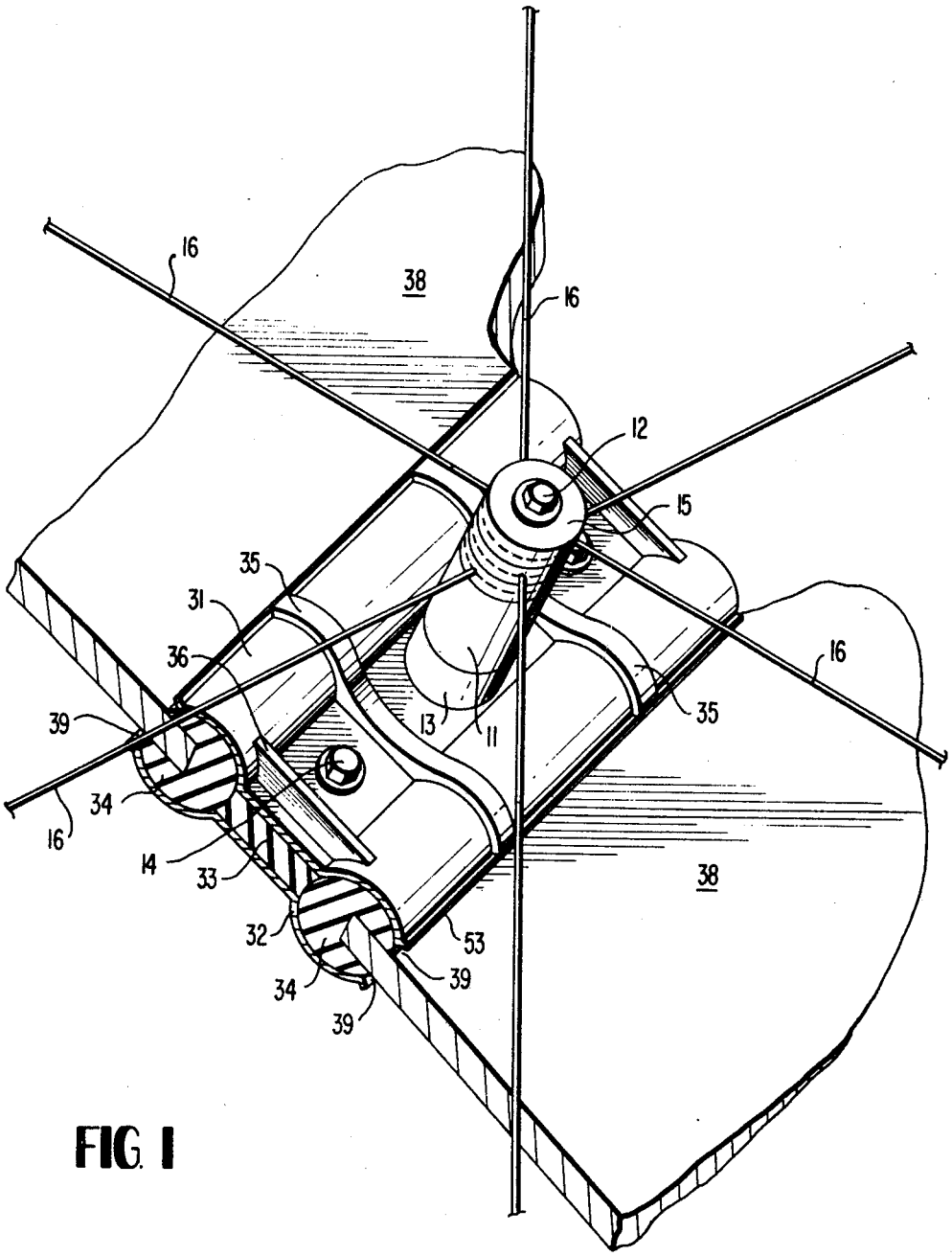
FIG. 1 is a perspective view of the lining or covering assembly disclosed in parent application Ser. No. 457,214.

Within the scope of this invention, a fabric cover is intended to mean coated and uncoated fabrics of natural fibers as well as synthetic fibers, respectively, and also sheets, i.e. non-woven synthetic resin films or plastic sheets. The important factor in this connection is that the fabrics, which are also designated as being of low flexural strength (having a low bending resistance), exhibit a sufficiently high tensile strength at rupture, namely in the direction of both warp and woof. This strength is to be generally larger than 200 kg. per 5 cm. of fabric cover width. Thus, for example, the PVC-coated polyester fabric preferably usable as the fabric cover has a tensile strength at rupture of 800 – 1000 kg. per 5 cm. of fabric cover width.

Other characteristic properties of the fabric cover usable in the system of this invention, such as, for example, light stability and weathering stability, are to be adapted to the respective purpose for which the product is employed. Also, it is possible, for example, to obtain a good thermal insulation by using a fabric cover consisting of several layers or provided with an insulating layer. No protection is claimed within the scope of this invention for the structure (single-layer or multiple-layer, with or without fabric reinforcement, with or without insulating layer, etc.) or for the starting material (cotton, synthetic fabric, films, sheets, for example of polyethylene) or for the method of manufacture (weaving, spreading, dipping, casting, etc.) of the fabric cover.

To safely absorb the stresses of all possibly occurring loads, primarily the wind load (pressure and suction), and for stabilization, the fabric cover must always be under tensile stress. This is to prevent fluttering of the low-flexural-strength lining. Such a tensile stress can be obtained in the system of this invention, for example,, by a spatial double curvature of the fabric cover. This is attained, for instance, by imparting to the covering, disposed between the generatrices of the hyperboloid of rotation an additional configuration formed of mutually offset waves, as for example a mutually offset sinusoidal shape. The generatrices of the hyperboloid of rotation being spaced apart at the technically necessary distance. In other words, in addition to being shaped to conform to the support means to be covered, fabric cover 17 as shown in FIG. 2 is further shaped so that it defines mutually offset sinusoidal undulations or undulations of another spatial double curvature arrangement. This is attained under practical conditions by attaching the connector panels and/or strips by means of spacer rings 13 and/or rigid or elastic intermediate members 11 in the longitudinal direction and/or in the direction of the generatrix at different heights with respect to the basic construction e.g. a rope mesh, in a wavy (sinusoidal) configuration to the basic construction.

In other words, the connector means used to hold the fabric cover are mounted at varying distances from the support means. Thus, FIG. 2 shows that connector panels and/or strips 31, 32 are spaced by means of spacer means such as spacer rings 13 and/or rigid or elastic intermediate members 11 (in the longitudinal direction and/or in the direction of the generatrix) at different heights with respect to the basic construction or network, i.e. crossed ropes 16, so that fabric cover 17 is supported in a wavy or sinusoidal configuration.

Figure 3:
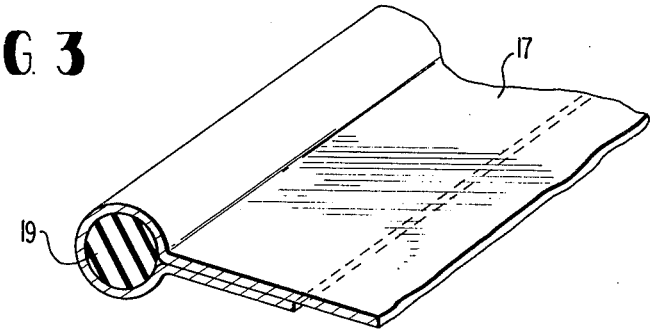
FIG. 3 is a perspective view illustrating the manner in which a fabric cover is reinforced on its edges in accordance with the present invention.

Fabric cover 17 of the present invention corresponds to the covering panels 38 in the system described in parent application 457,214, fabric cover 17 being held in the bearing profile members 34 of the connector panels or strips 31, 34 in accordance with the system of the present invention. As shown in FIG. 3, fabric cover 17 is preferably first looped at its intended fastening edge about an optionally reinforced loop 19 made of, for example, vulcanized rubber, steel cable, hemp rope and so forth. Preferably loop 19 is made from ethylene-propylene-diene rubber (EPDM).

After looping, the overlapping portion of fabric cover 17 is attached to the body of the fabric cover by sewing, gluing, cementing, clamping, tieing, welding, etc. The thus-finished fabric cover 17 is then embedded in the half-shells of the bearing profile members 34 adapted to the shape of the loop by corresponding recesses, and is held by the connector panels or strips 31, 32. See FIG. 4. In this way, a mounting has been provided ensuring safety against tearing out of the arrangement and simultaneously effecting an additionally desirable damping of any possibly occurring deformations from normal forces.

Figure 4:
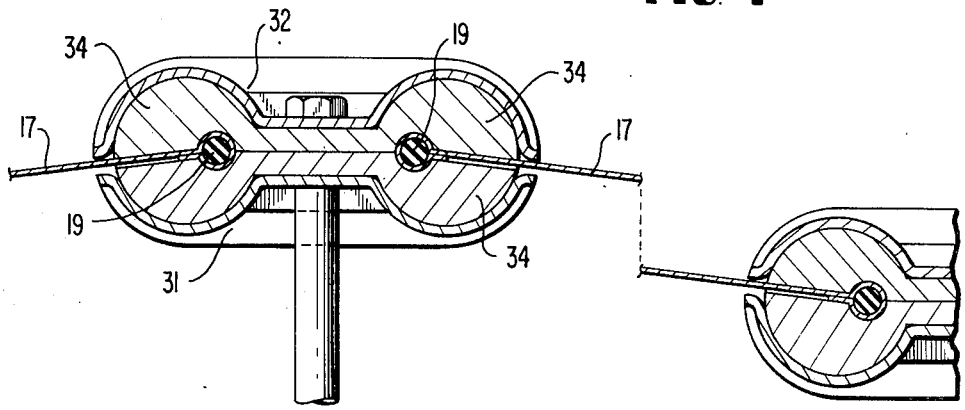
FIG. 4 is a cross-sectional view of a connector panel employed in the system of the present invention and carrying fabric covers in accordance with the present invention.
Figure 7:
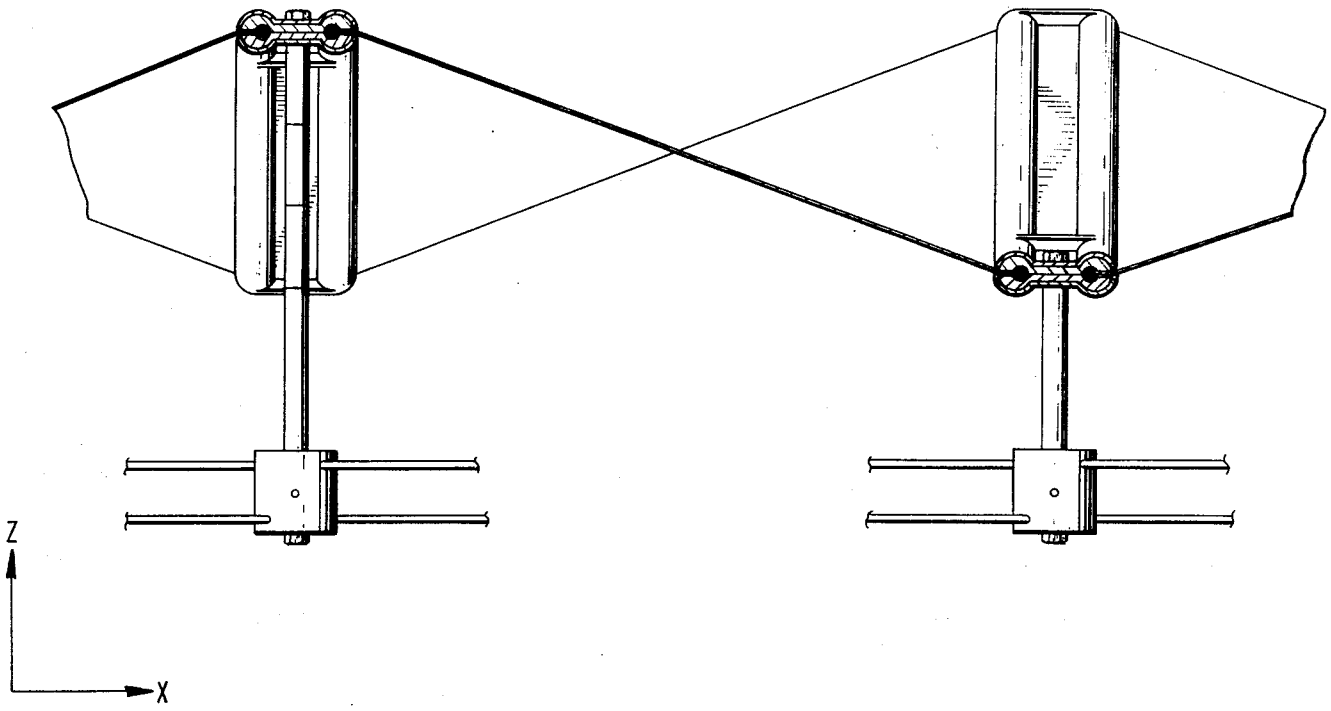
FIG. 7 is an X–Z cross-secttion taken from an X–Z plane passing through fabric cover 17 immediately in front of intermediate element 11 in the center of the Figure.

Adjoining fabric cover or diaphragm-type linings or sheaths forming a single fabric cover 17 are joined together along transverse seams, for example in accordance with FIG. 4. The joining can be accomplished as described above for the attachment to the loop.

If fabric covers 17 are connected to the basic construction or network by means of connector panels rather than connector strips, the areas present as shown in FIG. 5 between the connector panels and not affected by the fabric covers (i.e. open or uncovered areas) are covered by additional fabric covering or sealing strips 51. See FIG. 6. Fabric covering or sealing strips 51 can be held advantageously at two opposite sides by the connector panels by a clamping action and can be joined to the fabric covers 17 along their longitudinal edges by sewing, gluing, clamping, tying, welding, and so forth. It may also be advantageous to additionally join fabric covers 17, which are edge-reinforced by loops, in a flexible manner, for example, by a cord 52 or alternately brackets before the sealing strip is placed thereon and attached.

The system of this invention can be utilized advantageously for the covering of large areas, for example, with the aid of a rope network. Also, coverings for corresponding load-bearing structures are possible.

The foregoing description has been presented for illustrative purposes only and is not intended to limit the invention in any way. All reasonable modifications not specifically set forth are intended to be included within the scope of the present invention which is to be limited only by the following claims.

What is claimed is:

1. An assembly for sheathing a network thereby forming a structure having generally curved surfaces comprising:

a. a connector panel or strip adapted to be joined to the network via a firm or elastic intermediate element, said connector panel or strip comprising at least two associated clamping plates or strips and a filling panel therebetween to regulate the distance between the individual clamping plates or strips, said connector panel or strip holding two bearing profile members of a weather resistant and aging-resistant vulcanized elastomer, and b. a covering panel attached to at least one of the bearing profile members held by the connector panel or strip, said covering panel being shaped to fit said network and comprising a fabric cover stretched in the manner of a diaphram so that it exhibits a spatial double curvature and is under tensile stress.

2. The assembly according to claim 1, wherein said fabric cover is a polyvinyl chloride coated polyester fabric.

3. The assembly of claim 1, wherein said fabric cover has a tensile strength at rupture which is greater than 200 kg. per 5 cm. of strip width.

4. The assembly of claim 3, further including fastening means for holding said two clamping plates or strips together whereby said covering panel is elastically retained by said connector panel or strip.

5. The assembly of claim 3, wherein said two clamping plates or strips define, when assambled together, cylindrical spaces, said bearing profile members being cylindrical in shape and maintained in said cylindrical spaces such that said bearing profile members are capable of rotating in said spaces.

6. An assembly according to claim 5, wherein the intermediate mounting means connecting respective connector means with said fabric cover have different lengths whereby said fabric body defines mutually offset undulations.

7. An assembly according to claim 6, wherein said undulations are sinusoidal.

8. The assembly according to claim 3, wherein said covering panel is reinforced at its edges.

9. The assembly according to claim 8, wherein said covering panel is reinforced by means of a loop made of vulcanized rubber, steel cable, hemp rope or ethylene-propylene-diene rubber.

10. The assembly of claim 3, wherein said fabric cover is shaped to conform to the portion of the network said fabric cover lines, said fabric cover further defining mutually offset undulations.

11. The assembly of claim 10, wherein said undulations are sinusoidal.

12. An assembly for forming a structure having generally curved surfaces comprising:

a. support means b. a plurality of connector panels or strips joined to the support means via intermediate mounting means, each connector panel or strip comprising at least two associated clamping plates or strips and a filling panel therebetween to regulate the distance between the individual clamping plates or strips, at least some of said connector panels or strips respectively holding two bearing profile members of a weather resistant and aging-resistant vulcanized elastomer, and c. at least one covering panel attached to the bearing profile members of at least some of said connector panels or strips so that said at least one covering panel is elastically retained by a plurality of connector panels or strips, said at least one covering panel comprising a flexible fabric cover having a tensile strength of at least about 200 kg/5cm width, said fabric cover defining a spatial double curvature and being shaped to cover at least a portion of said support means, said fabric cover being under tensile stress.

13. The assembly of claim 12, wherein said fabric cover has a tensile strength at rupture which is greater than 200 kg. per 5 cm. of strip width.

14. The assembly according to claim 12, further comprising at least one spacer means connected to at least one of said mounting means for spacing at least one of said connector panels or strips from said support means.

15. The assembly according to claim 12, wherein said fabric cover is shaped to conform to the portion of the support means said fabric cover lines, said fabric cover further defining mutually offset undulations.

16. The assembly of claim 15, wherein said undulations are sinusoidal.

17. The assembly of claim 12, wherein said intermediate mounting means is elastic.

18. The assembly of claim 12, wherein said intermediate mounting means is rigid.

19. The assembly of claim 12, wherein said fabric cover is a polyvinyl chloride-coated polyester fabric.

20. The assembly of claim 12, wherein the two clamping plates or strips of each connector panel or strip define, when assembled together, cylindrical spaces, said bearing profile members being cylindrical in shape and maintained in said cylindrical spaces such that said bearing profile members are capable of rotating in said spaces.

21. The assembly of claim 12, wherein said at least one covering panel is reinforced at its edges.

22. The assembly of claim 12, wherein said at least one covering panel is reinforced by means of a loop made of vulcanized rubber, steel cable, hemp rope or ethylene-propylene-diene rubber.

* * * * *